US005244209A

United States Patent [19]

Benzel

[11] Patent Number: 5,244,209

[45] Date of Patent: Sep. 14, 1993

[54] GOLF GRIP APPARATUS

[76] Inventor: William P. Benzel, Six Sylvan Heights Dr., Hollidaysburg, Blair County, Pa. 16648

[21] Appl. No.: 731,002

[22] Filed: Jul. 16, 1991

[51] Int. Cl.[5] ..... A63B 53/14

[52] U.S. Cl. ..... 273/162 R; 273/81 A

[58] Field of Search ... 273/81 R, 81 A, 162 R-162 F, 273/32 R-32 B, 32 D, 73 J, 75, 67 DB, 167 F, 169, 171, 77 R

[56] References Cited

U.S. PATENT DOCUMENTS

| | | | |
|---|---|---|---|
| 1,575,364 | 2/1926 | Hodgkins | 273/171 |
| 1,840,924 | 1/1932 | Tucker | 273/171 |
| 2,121,289 | 6/1938 | Gleadall | 273/73 J |
| 2,782,035 | 2/1957 | East | 273/81 R |
| 3,075,768 | 1/1963 | Karns | 273/81 A |
| 3,116,926 | 1/1964 | Owen et al. | 273/171 |
| 3,606,327 | 9/1971 | Gorman | 273/81 A |
| 3,645,008 | 2/1972 | Delsack | 273/73 J X |
| 4,052,075 | 10/1977 | Daly | 273/171 |
| 4,600,195 | 7/1986 | Hunter | 273/81 A |
| 4,930,785 | 6/1990 | Mills | 273/81 A X |
| 4,936,586 | 6/1990 | Raemdonck | 273/81 A X |

FOREIGN PATENT DOCUMENTS

| | | | |
|---|---|---|---|
| 1473295 | 2/1967 | France | 273/81 R |
| 13337 | of 1912 | United Kingdom | 273/81 A |
| 174550 | 2/1922 | United Kingdom | 273/81 A |

OTHER PUBLICATIONS

A brochure of Para-Tech for The Enforcer grip, 1987.
A brochure of Applied Sports Physics, Inc. for its Top-weights device, Feb. 1990.

*Primary Examiner*—V. Millin
*Assistant Examiner*—Sebastiano Passaniti
*Attorney, Agent, or Firm*—John F. A. Earley; John F. A. Earley, III

[57] ABSTRACT

A grip apparatus adapted to be mounted on the end portion of a golf club shaft for enabling the swing weight of a golf club to be adjusted as desired comprises a hollow cylindrical plug, a compartment formed inside the plug for holding a weighting material, the plug having an opening at a first end portion to permit adding weighting material to the compartment inside the plug or removing weighting material from the compartment inside the plug, a shoulder stop mounted on the first end portion of the plug for preventing the plug from being inserted into the golf club shaft more than the length of the plug, a grip for covering the outside end portion of the golf club shaft, and a cap for closing the opening in the plug to secure the weighting material inside the plug.

11 Claims, 2 Drawing Sheets

GOLF GRIP APPARATUS

BACKGROUND OF THE INVENTION

1. Field of the Invention

This invention relates to golf clubs, and more particularly concerns the grip apparatus for a golf club which enables the swing weight of the golf club to be varied as desired.

2. Description of the Prior Art

For years, golfers, especially weekend golfers, have desired to hit the golf ball farther.

Some golfers have attempted to gain extra distance by increasing the shaft lengths of their clubs. However, by increasing the length of the golf club shaft, the swing weight (balance) of the club is altered, and such a club, with its new swing weight, may be difficult for a golfer to control. That is, although the golf club is longer so that theoretically a golf ball hit by it should go farther, its new balance may make the golf club difficult to control, resulting in mis-hit shots that do not go straight or very far.

For example, a golf club having a shaft of 43" may have a swing weight of C-0. Substituting a 45" long shaft for the 43" long shaft may change the swing weight from C-0 to E-0, and this new swing weight may be difficult to control for someone used to swinging a golf club having a swing weight of C-0.

SUMMARY OF THE INVENTION

It is a object of the invention to provide a grip apparatus for a golf club that enables the swing weight of the golf club to be altered at any time, as desired.

Another object is to provide a golf club having a grip apparatus that enables the swing weight of the golf club to be adjusted as needed to coincide with how a golfer is swinging on any particular day.

These and other objects are accomplished by providing a grip apparatus adapted to be mounted on the end portion of a golf club shaft and by providing a golf club equipped with such a grip apparatus. The grip apparatus comprises a hollow cylindrical plug, a compartment formed inside the plug for holding a weighting material, the plug having an opening at a first end portion to permit adding weighting material to the compartment inside the plug or removing weighting material from the compartment inside the plug, shoulder stop means mounted on the first end portion of the plug for preventing the plug from being inserted into the golf club shaft more than the length of the plug, a grip for covering the outside end portion of the golf club shaft, and a cap for closing the opening of the plug to secure the weighting material inside the plug.

DETAILED DESCRIPTION

Figure 1:
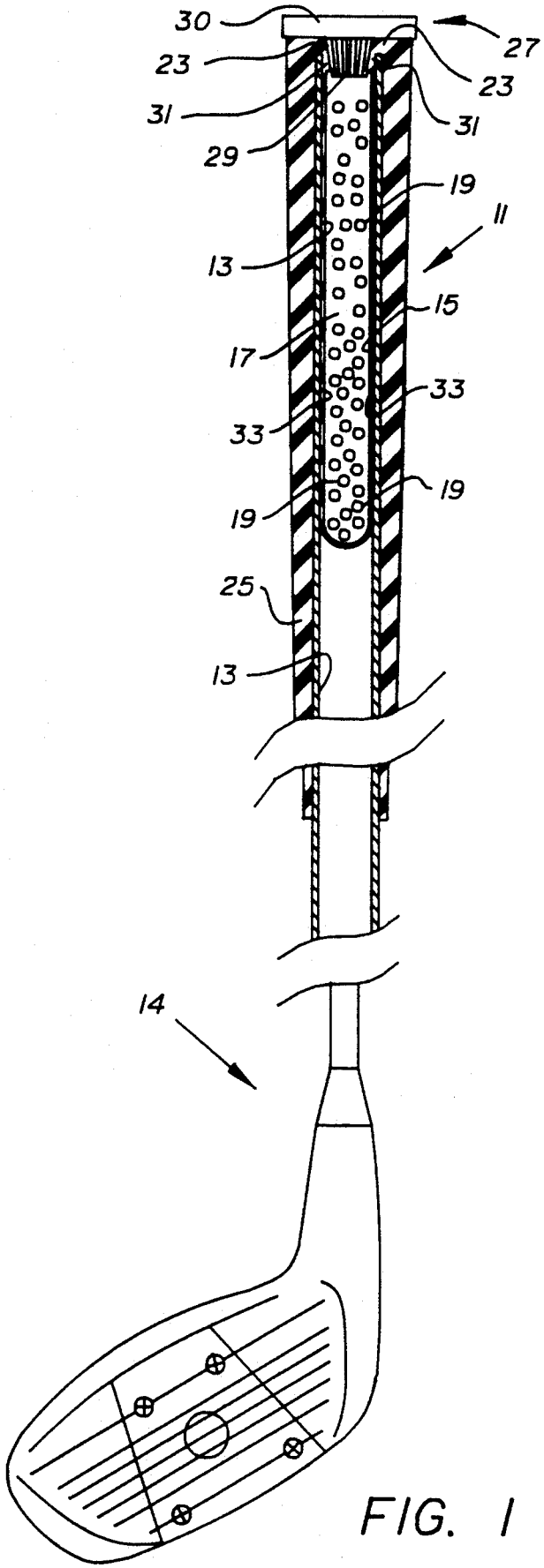
FIG. 1 is a partial view in section showing a grip apparatus constructed in accordance with this invention mounted on a golf club.
Figure 2:
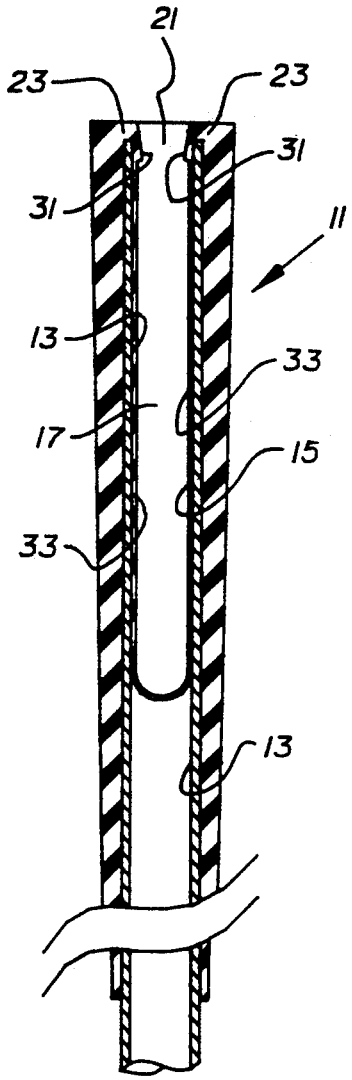
FIG. 2 is a partial view in section showing the grip apparatus of FIG. 1 without its cap.

Turning to the drawings, there is shown in FIGS. 1 and 2 a grip apparatus 11 mounted on the end portion of a golf club shaft 13 of a golf club 14.

Grip apparatus 11 includes a hollow cylindrical plug 15, and a compartment 17 is formed inside plug 15 for holding a weighting material 19, which may be BB shot pellets.

Plug 15 has an opening 21 (FIG. 2) at its upper end to permit adding weighting material 19 (FIG. 1), such as BB shot pellets, to compartment 17 or to permit removing weighting material 19 from compartment 17.

A shoulder stop 23, in the form of an outwardly extending annular-shaped ledge, extends outwardly from the upper end portion of plug 15 and has an outer diameter which is larger than the inner diameter of the golf club shaft 13 to prevent the plug 15 from being inserted down into the golf club shaft 13 more than the length of the plug 15. Shoulder stop 23 engages the upper edge of the golf club shaft 13 to position the plug 15 at the upper end portion of the shaft 13.

A grip 25 extends downwardly from shoulder stop 23 and covers the outside of the upper portion of the golf club shaft 13.

Referring to FIG. 1, cap 27 is provided for closing top opening 21 of compartment 17 to secure the weighting material 19 inside plug 15. Cap 27 has a solid cup-shaped body portion 29, which is corrugated. Cap 27 has a solid cylindrically shaped upper end portion 30 which extends beyond the circumference of the body portion 29 so that its outside perimeter is flush with the outside perimeter of grip 25. Cap body portion 29 is shaped such that it may be press fitted against an inwardly extending annular projection 31 formed in the upper end portion of the plug 15 to secure cap 27 in opening 21 of plug 15.

In the embodiment shown in FIGS. 1 and 2, the plug 15, the shoulder stop 23, and the grip 25 are made integral with one another for easy insertion into shaft 13 and for easy removal from shaft 13.

Preferably, grip apparatus 11 is made of rubber. However, synthetic plastics and other suitable materials may be used.

To mount grip apparatus 11 on the end portion of a golf club shaft 13, standard methods used for securing conventional golf club grips to golf club shafts may be used. When grip apparatus 11 is mounted on golf club shaft 13, the grip apparatus 11 secures the upper end portion of golf club shaft 13 in the space 33 between plug 15 and grip 25, and shoulder stop 23 of plug 15 engages the upper edge of the golf club shaft 13.

In use, the swing weight of a golf club 14 provided with grip apparatus 11 may be varied as desired. By adding weighting material 19 to compartment 17 you add weight to the handle and decrease the swing weight because the weight of the club head remains the same. By removing some of the weighting material 19 from compartment 17 you decrease the weight of the handle and increase the swing weight.

Specifically, to decrease the swing weight of the golf club 14, cap 27 is pulled from opening 21, and weighting material 19 is inserted through opening 21 into compartment 17 of plug 15. After the desired amount of weighting material 19 has been placed in compartment 17, stuffing material (not shown in the drawings) such as paper, fabric or the like, optionally may be pushed into compartment 17 against the weighting material 19 to pack the weighting material together and to keep the weighting material 19 from rattling when the golf club 14 is being used. Cap 27 is then pushed into opening 21, with body portion 29 of cap 27 press fitted against the inwardly extending annular projection 31 formed in the upper end portion of the plug 15.

To increase the swing weight of the golf club 14, cap 27 is pulled from opening 21, the stuffing material is pulled from compartment 17 of plug 15, and the golf club 14 is tilted downwardly to permit some or all of the weighting material 19 to fall out of plug 15 through opening 21. When the desired amount of weighting material 19 has been removed from plug 15, the stuffing material is pushed back into compartment 17 to keep the weighting material remaining in the plug 15 from rattling, and then cap 27 is pushed into opening 21 to close compartment 17.

If a particular swing weight is desired, weighting material may be added to or removed from compartment 17 until the desired swing weight is obtained. For example, if golf club 14 has a swing weight of D-9 when compartment 17 is empty, and a lighter swing weight of C-5 is desired, the swing weight of the club 14 may be changed to C-5 by adding weighting material 19 to compartment 17 until the C-5 swing weight is reached.

Likewise, a swing weight of a club 14 having a swing weight of B-0 may be changed to a heavier swing weight, such as D-4, by removing a sufficient amount of weighting material 19 from compartment 17.

The exact amount of weighting material 19 needed to change the swing weight of a club from one swing weight to another swing weight may be determined by repeating the following steps until the desired swing weight is reached: removing the cap 27 and stuffing material, adding or removing material weighting material 19 as the case may be, replacing the stuffing material and cap 27, and weighing the club on a swing weight scale.

Figure 3:
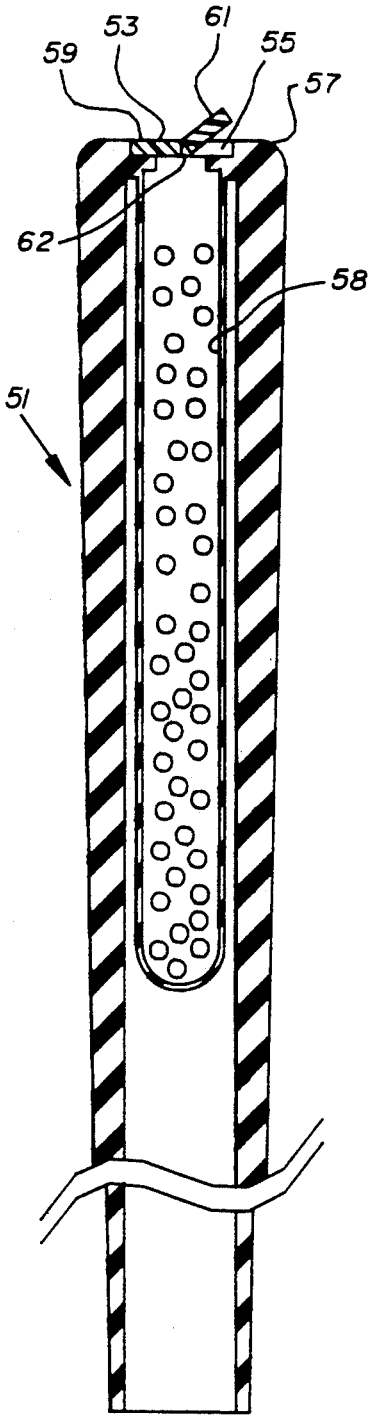
FIG. 3 is a view in cross section showing an alternative embodiment of the grip apparatus of the invention.
Figure 4:
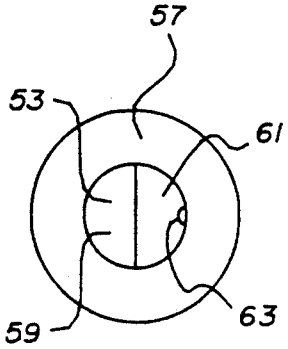
FIG. 4 is a top plan view of the grip apparatus shown in FIG. 3 showing a cap in a closed position.
Figure 5:
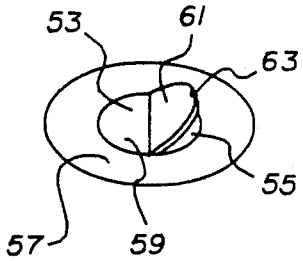
FIG. 5 is a perspective view of the cap shown in FIG. 4.

FIGS. 3-5 show an alternative embodiment of the invention. In this embodiment, grip apparatus 51 has a hinged plastic cap 53 instead of the cap 27 of grip apparatus 11, and grip apparatus 51 has an annular recess 55 formed in the upper end portion 57 of its grip above the plug 58 instead of the inwardly extending annular projection 31 of grip apparatus 11.

Cap 53 is partially cut through at its diameter to form a first semi-circular portion 59 hinged to a second semi-circular portion 61. First semi-circular portion 59 is glued into a corresponding portion of annular recess 55 and second semi-circular portion 61 may be swung open like a door to gain access to the inside of the plug or may be snapped shut into the corresponding portion of annular recess 55, a press fit, to close the opening 62 of the plug. To aid in opening cap 53, second semi-circular portion 61 is provided with an indentation 63 formed in its outer circumference. A golf tee may be used to pry open cap 53 with the pointed end of the golf tee being pushed into the indentation 63.

Grip apparatus 51 is mounted on a golf club shaft in the same manner as grip apparatus 11, and grip apparatus 51 is used in the same way as grip apparatus 11.

Figure 6:
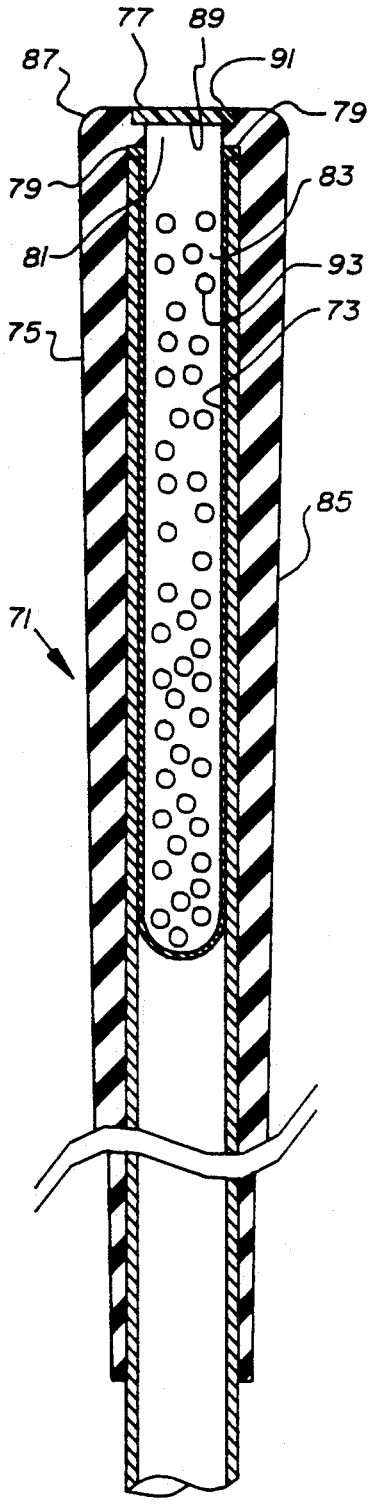
FIG. 6 is a view in cross section of another alternative embodiment of the grip apparatus of the invention.

FIG. 6 shows another embodiment of the invention. In this embodiment, grip apparatus 71 has a plug 73 which is not integral with grip 75, and a non-hinged press-fit plastic cap 77 is used.

In this embodiment, hollow plug 73, which preferably is made of plastic or rubber, has a shoulder stop 79, in the form of an outwardly extending annular ledge, formed in its upper end portion. Plug 73 also has an opening 81 formed in its upper end portion which forms an entrance to compartment 83 inside plug 73.

Grip 75 has a portion 85, which covers the outside of a golf club shaft 88, and an upper end portion 87 which extends inwardly and overlaps shoulder stop 79 of plug 73. Upper end portion 87 of grip 75 has a top opening 89 which is aligned with opening 81 of plug 73. An annular recess 91 is formed in the upper end portion 87 of grip 75 which surrounds opening 81 and receives cap 77, a press fit, to close compartment 83.

Weighting material 93, such as BB shot pellets, may be added to or removed from compartment 83 via opening 81 as desired.

Grip apparatus 71 is mounted on a golf club shaft by inserting plug 73 into the upper end portion of the golf club shaft until shoulder stop 79 contacts the upper edge of the golf club shaft. Then, grip 75 is secured to the upper end portion of the golf club shaft using conventional adhesives and methods of adhering conventional grips to shafts.

Grip apparatus 71 is used the same way as grip apparatus 11 and grip apparatus 51.

In operation, the method of changing the swing weight of a golf club when desired comprises the steps of providing a hollow cylindrical plug having a compartment formed inside the plug for holding a weighting material, with the plug having a top opening to permit adding weighting material, such as BB shot pellets, to the compartment inside the plug or to permit removing the weighting material from the compartment inside the plug, shoulder means mounted on the top portion of the plug for preventing the plug from being inserted too far into the golf club shaft, more than the length of the plug, and a cap for closing the top opening in the plug to secure the weighting material inside the plug. Further steps include inserting the plug into the top end of a shaft of a golf club, preventing the plug from being inserted too deeply into the shaft by contacting the top of the shaft with the shoulder stop means, opening the plug by opening the cap, inserting a desired amount of weighting material into the plug to obtain a desired swing weight, or alternatively removing a desired amount of weighting material from the plug to obtain the desired swing weight, stuffing the plug with stuffing material to keep the weighting material from rattling when the club is being used, and closing the club by closing the shaft.

It will be realized that other modifications may be made to the invention as shown and described, without departing from the spirit and structure of the invention as defined in the attached claims. For instance, in the third embodiment of the invention, a leather grip may be substituted for rubber grip 75 and an appropriate cap substituted for cap 77.

ADVANTAGES

The swing weight of a golf club provided with a grip apparatus of the invention may be altered at any time by either adding more weighting material 19 to compartment 17, 83 or removing weighting material 19 from compartment 17, 83.

Accordingly, for many golfers whose swings change from day to day, each time golf is played the swing weight of the golf club may be adjusted to the optimum swing weight for how the golfer is swinging at that time.

Further, a golfer may obtain the benefit, i.e., extra distance, of using a longer golf club, and at the same time the golfer may swing in control since the swing weight of the golf club may be adjusted using the inventive grip apparatus 11, 51, 71 to the proper swing weight for that golfer.

What is claimed is:

1. Grip apparatus adapted to be mounted on an end portion of a golf club shaft for enabling the swing weight of a golf club to be adjusted as desired, comprising a hollow cylindrical plug, a compartment formed inside the plug for holding a weighting material, the plug having an opening at a first end portion to permit adding the weighting material to the compartment inside the plug or removing the weighting material from the compartment inside the plug, shoulder stop means mounted on the first end portion of the plug for preventing the plug from being inserted into the golf club shaft a distance greater than the length of the plug, and cap means adapted to be press fit into the opening in the plug for closing the opening and for securing the weighting material inside the plug, the plug having an inwardly extending annular projection formed in the first end portion, the cap means including a cap having a corrugated solid body portion having a truncated cone shape, the body portion of the cap being adapted to be press fit against the inwardly extending annular projection of the plug, and the cap having a solid cylindrically-shaped upper end portion which extends beyond the body portion to be flush with the grip.

2. A grip apparatus adapted to be mounted on an end portion of a golf club shaft for enabling the swing weight of a golf club to be adjusted as desired, comprising a hollow cylindrical plug, a compartment formed inside the plug for holding a weighting material, the plug having an opening at a first end portion to permit adding the weighting material to the compartment inside the plug or removing the weighting material from the compartment inside the plug, shoulder stop means mounted on the first end portion of the plug for preventing the plug from being inserted into the golf club shaft a distance greater than the length of the plug, a cap for closing the opening in the plug to secure the weighting material inside the plug, and a grip for covering a portion of the golf club shaft, the grip having an opening formed in an upper end portion aligned with the opening of the plug, the grip having an annular recess formed in the upper end portion surrounding the opening of the plug, the cap having a first portion hinged to a second portion, the first portion of the cap being affixed in the annular recess, and the second portion of the cap having an indentation to facilitate prying open the second portion with a golf tee.

3. A grip apparatus adapted to be mounted on an end portion of a golf club shaft for enabling the swing weight of a golf club to be adjusted as desired, comprising a hollow cylindrical plug, a compartment formed inside the plug for holding a weighting material, the plug having an opening at a first end portion to permit adding the weighting material to the compartment inside the plug or removing the weighting material from the compartment inside the plug, shoulder stop means mounted on the first end portion of the plug for preventing the plug from being inserted into the golf club shaft a distance greater than the length of the plug, a grip for covering a portion of the golf club shaft, cap means adapted to be press fit into the opening in the plug for closing the opening and for securing the weighting material inside the plug, the grip and the plug being integrally connected by the shoulder stop means, the plug having an inwardly extending annular projection formed in the first end portion of the plug, the cap means including a cap having a corrugated solid body portion having a truncated cone shape, the body portion of the cap being adapted to be press fit against the inwardly extending annular projection of the plug, the cap having a solid cylindrically-shaped upper end portion which extends beyond the body portion to be flush with the grip, and further including weighting material for insertion into the compartment of the plug, the weighting material being BB shot pellets.

4. A golf club, comprising a golf club shaft, a golf club head mounted on a first end portion of the golf club shaft, and a grip apparatus mounted on a second end portion of the golf club shaft, the grip apparatus including a hollow cylindrical plug having a closed bottom and an open top, a compartment formed inside the plug for holding a weighting material, the plug having the open top at a first end portion to permit adding the weighting material to the compartment inside the plug or removing the weighting material from the compartment inside the plug, shoulder stop means mounted on the first end portion of the plug for preventing the plug from being inserted into the golf club shaft a distance greater than the length of the plug, a grip for covering a portion of the golf club shaft, and cap means adapted to be press fit into the open top in the plug for closing the open top and for securing the weighting material inside the plug.

5. The golf club of claim 4, the grip and the plug being of one-piece construction and integrally connected by the shoulder stop means.

6. The golf club of claim 4, further including weighting material for insertion into the compartment of the plug.

7. The golf club of claim 6, the weighting material being BB shot pellets.

8. A golf club, comprising a golf club shaft,
a golf club head mounted on a first end portion of the golf club shaft,
and a grip apparatus mounted on a second end portion of the golf club shaft,
the grip apparatus including
a hollow cylindrical plug,
a compartment formed inside the plug for holding a weighting material,
the plug having an opening at a first end portion to permit adding the weighting material to the compartment inside the plug or removing the weighting material from the compartment inside the plug,
shoulder stop means mounted on the first end portion of the plug for preventing the plug from being inserted into the golf club shaft a distance greater than the length of the plug,
a grip for covering a portion of the golf club shaft, and
cap means adapted to be press fit into the opening in the plug for closing the opening and for securing the weighting material inside the plug,
the plug having an inwardly extending annular projection formed in the first end portion of the plug,
the cap means including a cap having a corrugated solid body portion having a truncated cone shape, the body portion of the cap being adapted to be press fit against an inwardly extending annular projection of the plug, and
the cap having a solid cylindrically-shaped upper end portion which extends beyond the body portion to be flush with the grip.

9. A golf club, comprising
a golf club shaft,
a golf club head mounted on a first end portion of the golf club shaft,
and a grip apparatus mounted on a second end portion of the golf club shaft,
the grip apparatus including
a hollow cylindrical plug,
a compartment formed inside the plug for holding a weighting material,
the plug having an opening at a first end portion to permit adding the weighting material to the compartment inside the plug or removing the weighting material from the compartment inside the plug,
shoulder stop means mounted on the first end portion of the plug for preventing the plug from being inserted into the golf club shaft a distance greater than the length of the plug,
a grip for covering a portion of the golf club shaft, and
a cap for closing the opening in the plug to secure the weighting material inside the plug,
the grip having an opening formed in an upper end portion aligned with the opening of the plug,
the grip having an annular recess formed in the upper end portion surrounding the opening of the plug,
the cap having a first portion hinged to a second portion, the first portion of the cap being affixed in the annular recess, and the second portion of the cap having an indentation to facilitate prying open the second portion with a golf tee.

10. A golf club, comprising
a golf club shaft,
a golf club head mounted on a first end portion of the golf club shaft,
and a grip apparatus mounted on a second end portion of the golf club shaft,
the grip apparatus including
a hollow cylindrical plug,
a compartment formed inside the plug for holding a weighting material,
the plug having an opening at a first end portion to permit adding the weighting material to the compartment inside the plug or removing the weighting material from the compartment inside the plug,
shoulder stop means mounted on the first end portion of the plug for preventing the plug from being inserted into the golf club shaft a distance greater than the length of the plug,
a grip for covering a portion of the golf club shaft,
cap means adapted to be press fit into the opening in the plug for closing the opening and for securing the weighting material inside the plug,
the grip and the plug being integrally connected by the shoulder stop means,
the plug having an inwardly extending annular projection formed in the first end portion of the plug,
the cap means including a cap having a corrugated solid body portion having a truncated cone shape, the body portion of the cap being adapted to be press fit against the inwardly extending annular projection of the plug,
the cap having a solid cylindrically-shaped upper end portion which extends beyond the body portion to be flush with the grip, and
further including weighting material for insertion into the compartment of the plug,
the weighting material being BB shot pellets.

11. A method of changing the swing weight of a golf club when desired, comprising the steps of
mounting a grip apparatus on an end portion of a golf club shaft, the grip apparatus having a hollow cylindrical plug having a closed bottom compartment formed inside the plug for holding a weighting material, the plug having a top opening to permit adding the weighting material to the compartment inside the plug or removing the weighting material from the compartment inside the plug, shoulder stop means mounted on a top end of the plug for preventing the plug from being inserted into a golf club shaft a distance greater than the length of the plug, and cap means adapted to be press fit into the opening in the plug for closing the opening and for securing the weighting material inside the plug,
preventing the plug from being inserted too deeply into the shaft by contacting a top of the shaft with the shoulder stop means,
opening the plug by removing at least a portion of the cap means from the opening of the plug,
inserting a desired amount of weighting material into the plug to obtain a desired swing weight,
stuffing the plug with stuffing material to keep the weighting material from rattling when the golf club is being used, and
closing the plug by replacing the cap means.

* * * * *